US005232359A

United States Patent [19]

Campbell, Jr. et al.

[11] Patent Number: 5,232,359

[45] Date of Patent: Aug. 3, 1993

[54] DEVICE FOR INCREASING THE THERMAL RADIATION HEAT TRANSFER ON AN OBJECT IN A FURNACE

[76] Inventors: Frank Campbell, Jr., 6923 Ashmore Dr., Houston, Tex. 77069; Ernest J. Klotz, Jr., Rte. 1, Box 39K, East Bernard, Tex. 77345

[21] Appl. No.: 736,652

[22] Filed: Jul. 26, 1991

[51] Int. Cl.[5] ..... F27D 3/00

[52] U.S. Cl. ..... 432/234; 432/239; 432/121; 432/127

[58] Field of Search ..... 422/233-236, 422/258, 127, 121, 239

[56] References Cited

U.S. PATENT DOCUMENTS

| | | | |
|---|---|---|---|
| 2,884,879 | 5/1959 | Corriston | 432/234 |
| 3,706,448 | 12/1972 | Salter et al. | 266/1 R |
| 3,915,441 | 10/1975 | Matsukawa et al. | 266/5 |
| 4,035,141 | 7/1977 | Knaak | 432/234 |
| 4,056,350 | 11/1977 | Knaak | 432/234 |
| 4,293,299 | 10/1981 | Gaddes | 432/233 |
| 4,368,038 | 1/1983 | Bourdon | 432/253 |
| 4,391,587 | 7/1983 | Murakami et al. | 432/121 |
| 4,427,187 | 1/1984 | Denis | 266/274 |
| 4,609,347 | 9/1986 | Yamashita | 432/234 |
| 4,747,775 | 5/1988 | Takagi | 432/234 |
| 4,886,450 | 12/1989 | Heuss | 432/239 |
| 4,900,248 | 2/1990 | Terai | 432/234 |
| 4,936,771 | 6/1990 | Sidwell | 432/127 |

*Primary Examiner*—Henry C. Yuen
*Attorney, Agent, or Firm*—Fulbright & Jaworski

[57] ABSTRACT

The invention relates to a method for increasing the thermal radiation heat transfer between a metallurgical reheat furnace and the object being heated within the furnace by increasing the distance between the water cooled skid pipes and the object itself thereby reducing the shadow effect of the support structure on the object being heated.

7 Claims, 13 Drawing Sheets

DEVICE FOR INCREASING THE THERMAL RADIATION HEAT TRANSFER ON AN OBJECT IN A FURNACE

BACKGROUND OF THE INVENTION

In the production of thin sheet metal used in such products as automobile bodies and household appliances, it is essential that the thin sheet metal exhibit the most attainable uniformity in thickness or gauge. When the thin sheet metal known by those skilled in the art as "strip" is stamped or pressed, it is extremely sensitive to any variations in the strip gauge.

Gauge variation in the strip causes stamping or pressing defects resulting in holes, tears, ripples or other flaws that often mandate scrapping the finished product.

The production of thin sheet metal or strip is most commonly accomplished by using two sequential manufacturing processes. The first step occurs in two phases. The first phase consists of reheating an object such as a slab to a temperature sufficient to produce pyroplasticity in the object. The second phase occurs in the hot strip mill. The hot strip mill process reduces the thickness of a large rectangular object such as a slab that has been heated to a temperature sufficiently high to allow pyro-plastic deformation. The slab typically has dimensions of about 9–10" thickness×30–84" width×30–40' length, and is usually heated from ambient temperatures (often 50°–90° F.) to 2000°–2500° F. depending on the type steel being processed. The slab may enter the reheat furnace at a higher temperature than the ambient temperature noted above if it has retained heat from prior processing steps.

Once the object such as a slab has been heated in the furnace, it is continually passed through a number of rolling mill stands positioned along the length of the mill. Each of the stands contains at least two large rotating cylindrical rolls between which the slab is passed and squeezed to reduce the thickness of and elongating the slab. The rolling mill process is by analogy closely akin to the well known washing machine wringer. The slab is squeezed between the rolls, and with each successive pass through each mill stand, the slab is incrementally reduced in thickness. The ultimate strip thickness is frequently in the range of 0.080–0.250" while the length is increased to as much as 4000 feet.

The strip is generally stored as a tightly rolled coil which is banded after cooling for ease of handling. Often the coil is then (1) annealed to result in a "dead" soft material, (2) pickled to remove foreign material such as residual scale and (3) further processed by cold rolling to achieve the desired final product gauge. The product gauge for certain uses is often in the range of 0.008–0.020".

The slabs are usually heated in a reheat furnace prior to processing into hot strip and plate products. It is this portion of the entire process of production to which the invention relates.

The furnace is generally either a pusher type or a walking beam type furnace. In both types of furnaces, a network of water-cooled piping commonly known as a skid system is used to support the slabs during the heating cycle. The skid system is usually water-cooled to maintain its mechanical strength at temperatures frequently in the range of 2450° F.

In pusher type furnaces, each skid comprises a horizontal, water-cooled pipe that is equipped with a steel or high temperature alloy wear bar affixed to the top of the skid pipe. The skids are orientated substantially parallel with the direction of the slab as it is pushed through the furnace. Larger pusher type furnaces often utilize 6 to 8 skids with 4 feet to 8 feet spacing between the skids. These skids are themselves supported by a number of horizontal pipes located below and orientated perpendicular to the skids. These support pipes are known by those skilled in the art as cross pipes and are themselves supported by vertical pipes that support the entire skid system and the slab riding atop the wear bars.

In the pusher type furnace, the slabs are usually mechanically or hydraulically forced into the furnace along the skids one after the other so that with each new slab that is pushed into the furnace, the other slabs that are already in the furnace are themselves pushed along the skids.

Those skilled in the art realize that heat is conducted from the slab, through the wear bar and into the water cooled pipe. Heat transfer is also lost to the slab due to the shadow cast on the underside of the slab by the skid. Newer pusher furnaces utilize an offset skid system to reduce thermal conduction from and to increase the thermal radiation upon the slab in order to even out the cold spots created by those effects.

Walking beam furnaces differ from pusher furnaces in part by eliminating the pushing mechanism. A walking beam furnace is equipped with auxiliary moveable skids that are usually located midway between the stationary skids. The continuous wear bars may be replaced with intermittent, spaced apart wear buttons that support the slab. These "walking skids" normally reside 4–6" below the stationary skids in order not to interfere with the radiant heat transfer from the burner blocks to the slab when the slab is at rest. The slab is transported through the furnace by the walking skids which are articulated by a combination of vertical and longitudinal linkages that (1) elevate the slab above the stationary skids, (2) move the slab load forward toward the discharge end of the furnace, (3) lower the slab onto the stationary skids and (4) then retract to the original position below the stationary skids. This sequence is repeated at calculated intervals to accommodate the desired pacing rate of the rolling mill.

Walking beam furnaces are emerging as a preferred type of furnace for heating steel slabs because: (1) damage to the bottom surface of the slab from scouring while being pushed through the furnace is reduced; (2) the slabs can be spaced with gaps between the adjacent slabs to increase the radiant heat transfer to those surfaces thereby reducing the heating time and improving fuel efficiency; (3) areas of lower temperatures known as cold spots are less intense because of the reduced area of slab contact with the non-continuous and smaller wear buttons that support the slabs; and (4) cold spot intensity is further reduced due to the periodic residence cycle and time that the slab spends in alternating contact between the stationary and walking skids.

Those skilled in the art understand that cold spots also occur in a slab in a walking beam furnace in part because of conduction of heat from the slab through the wear button into the water-cooled pipe and the shadow effect of the skids located between the heat sources or burner blocks of the furnace and the slab.

Cold spots occur more from the shadow effect upon the lower surface of the slab than from conductive heat transfer through the wear bar or wear button.

The prior art is replete with attempts to reduce the cold spots on the bottom surface of the slab or other object being heated within the furnace. For example, U.S. Pat. No. 4,936,771 issued to Sidwell discloses a structure for focusing the burners on top of the slab to a point on the upper surface of the slab directly opposite the cold spot generated below. U.S. Pat. No. 3,642,261 to Laws discloses a triangular skid pipe having alternating wear bars for distributing the cold spots. U.S. Pat. No. 4,391,587 to Murakami, et al discloses a connecting device which minimizes the number of vertical support pipes interfering with the flame pattern. Finally, U.S. Pat. No. 4,492,565 to Feroldi discloses a structure which actually turns a billet or bloom over 180 degrees at least once so that the cold spots are exposed upwardly. All of these devices as well as the prior art in general have not resolved the long felt need to reduce the shadow effect and the resulting cold spot upon the object to be heated.

The present invention directly relates to reducing the shadow effect caused by the skids on the slabs in both walking beam furnaces and pusher furnaces thereby increasing the thermal radiation heat transfer from the heat source to those slabs.

SUMMARY OF THE PRESENT INVENTION

The invention is a device for enhancing the thermal radiation heat transfer on an object within a furnace by reducing the shadow effect of the skids on an object such as slab. The device replaces the conventional method in both pusher and walking beam furnaces of securing the wear bars or wear buttons in close proximity to the skid pipes. The present invention provides a method for lowering the fluidically cooled skid pipe from the wear buttons and wear bars supporting the lower surface of the object being heated thereby reducing the overall shadow effect of that skid pipe on the slab.

Any type of conventional or specially designed skid pipe, regardless of the cross-sectional shape, will suffice for the first support structure of the invention. For a walking beam furnace, a second fluidically cooled support structure, for example, an upwardly extending water-cooled pipe termed a riser, is affixed at its lower end to the horizontal skid. The upper end of the upwardly projecting water-cooled pipe may be fitted with an appropriate wear button or cap in order to contact, position and support the overhead slab. Those skilled in the art will realize that the skid pipe and the upwardly projecting riser can be fluidically cooled from within by either the same or different fluid sources.

In pusher furnaces, a fluidically cooled, vertically elongated member referred to herein as a riser casting is secured at a lower end to the conventional skid pipe and terminates at an upper end with a suitable continuous or intermittent material for supporting and positioning the slab at an extended distance from the skid pipe.

It is an object of the present invention to increase the thermal radiation heat transfer in a furnace from the heat source to an object such as a slab.

It is a further object of the present invention to increase the thermal radiation heat transfer of a slab in a furnace by reducing the shadow effect of the skid pipes upon the lower surface of the slab being heated.

It is also an object of the present invention to reduce the shadow effect of the skids and cross pipes where appropriate on a slab being heated in a furnace by lowering the skid pipes in relation to the slab while at the same time retaining an effective support for the slab in the furnace.

Another object of the invention is to permit a reduction in the bulk temperature of the object being heated prior to rolling thereby reducing the amount of energy expended to achieve the desired pyroplasticity in the object.

These and other objects of the invention will become even more apparent when read in light of the specification, drawings, and the claims appended hereto.

Figure 11:
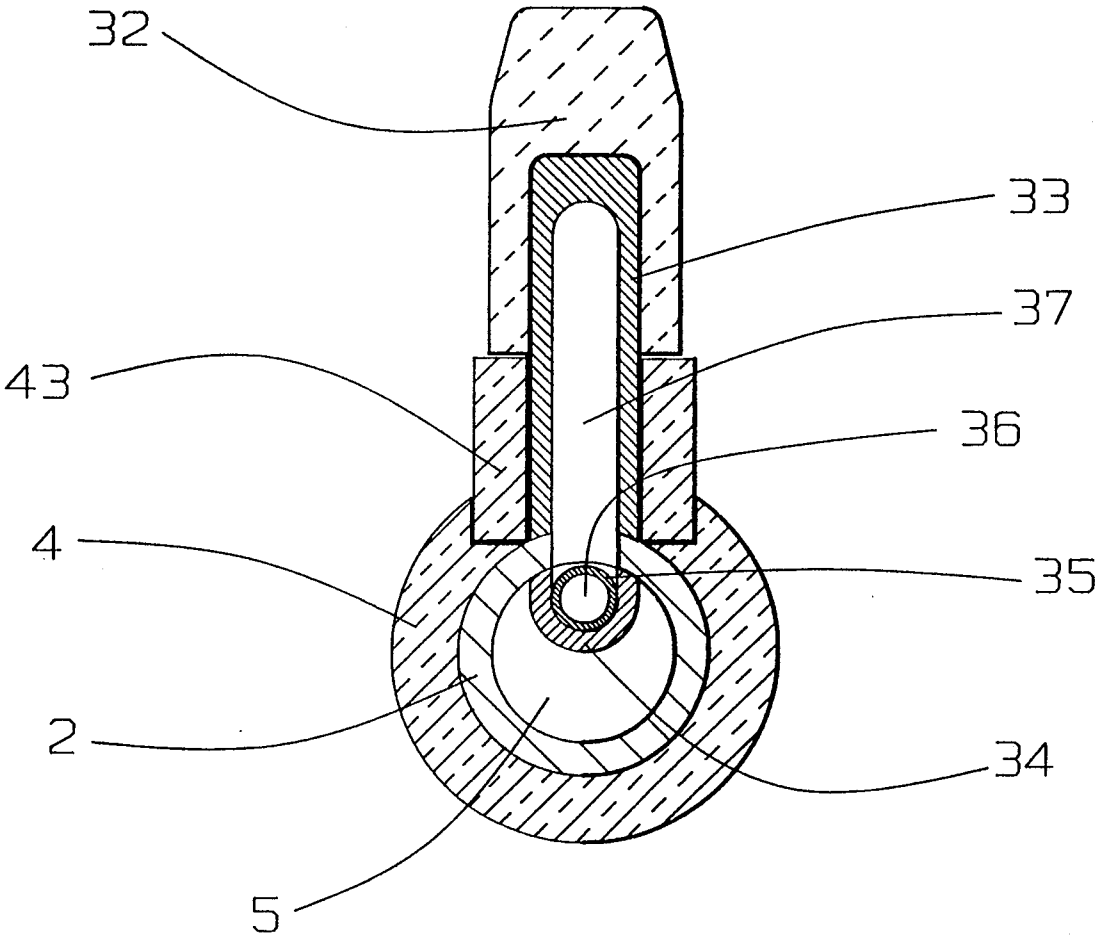
Figure 13:
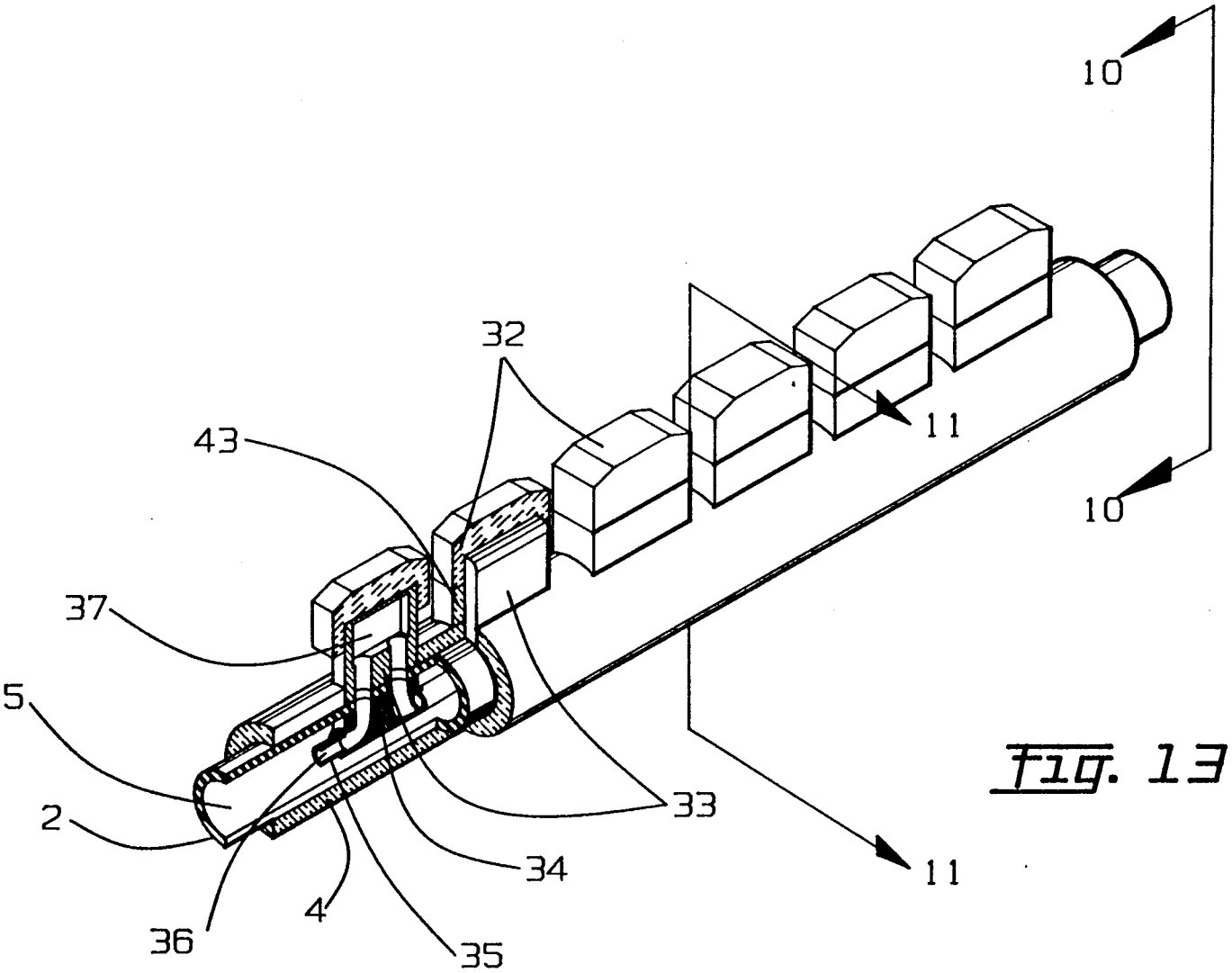

FIG. 11 is an end view in cross section viewed in the direction of lines 11—11 of FIG. 13 of the invention as applied to a pusher type furnace.

Figure 12:
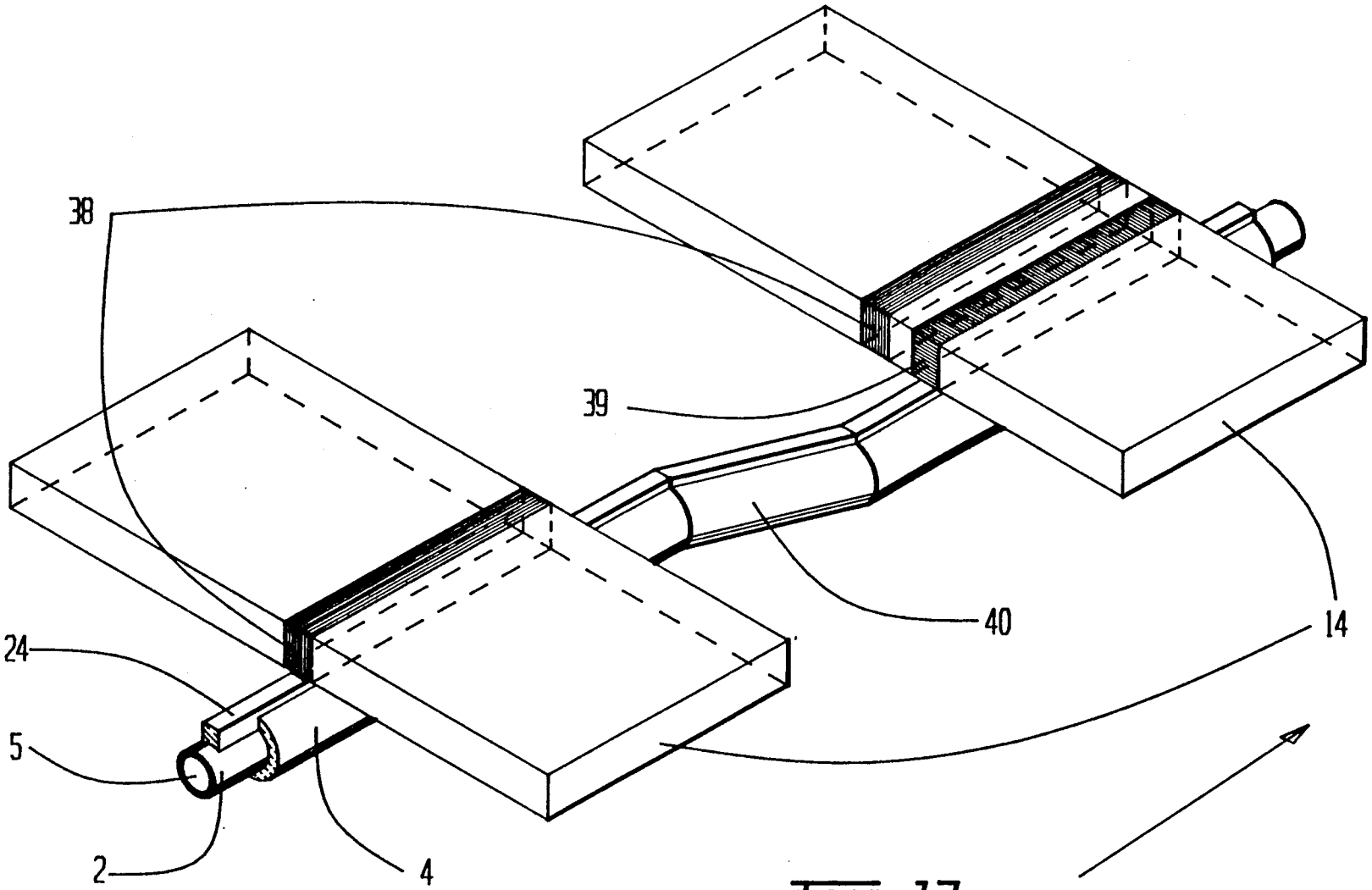

FIG. 12 is a segment of a conventional pusher type furnace showing the offsetting of the skid.

FIG. 13 is an isometric view in partial cross section of the invention as applied to a pusher furnace.

BRIEF DESCRIPTION OF THE PREFERRED EMBODIMENT

The present invention is a device for lowering the water-cooled skids away from the under side of a slab or other object being heated in a furnace in order to (1) reduce the shadow effect of the skid on the slab and (2) thereby increase the thermal radiation heat transfer from the burners in the furnace to the slab.

Figure 1:
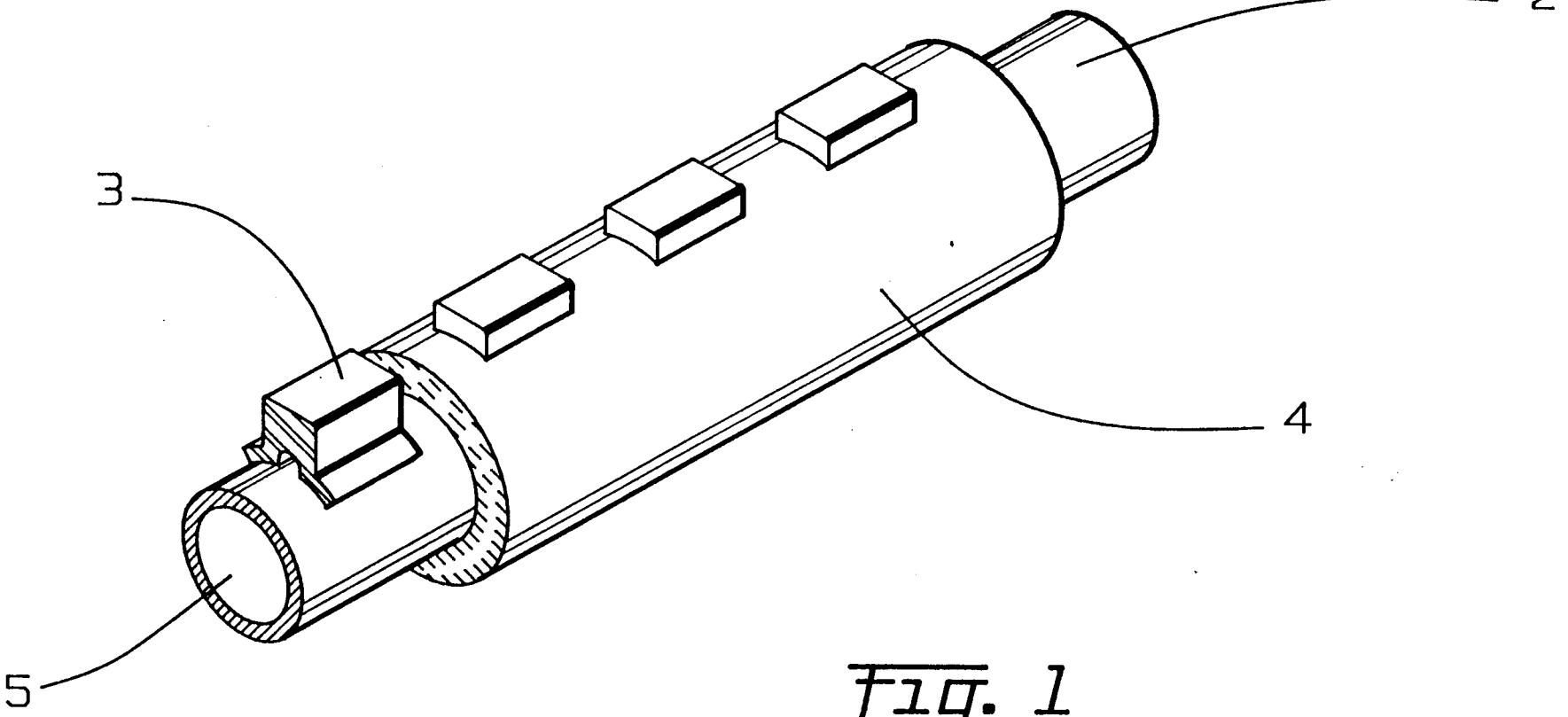
FIG. 1 is an isometric view of a section of a conventional skid pipe in a walking beam furnace showing a segment of the water-cooled pipe, a plurality of secured, intermittent wear buttons and a segment of insulation.

FIG. 1 shows a short piece of one type of conventional skid having a water-cooled pipe 2 with a passageway 5 therethrough for conducting a cooling fluid such as water. In walking beam furnaces, intermittently spaced apart alloy wear buttons 3 are secured to the pipe 2 by welding or perhaps by cleating the button 3 to the pipe 2. Those skilled in the art will understand that in pusher type furnaces, the intermittently spaced apart buttons 3 are usually a continuous wear bar 24 as shown in FIG. 12 in order to withstand the frictional forces exerted on the wear bar 24 as the slab is pushed through the furnace. An insulator 4 generally covers the pipe 2 and a portion of each wear button 3 or wear bar 24. Those skilled in the art will further understand that the pipe 2 is a conventional pipe and can take a number of cross sectional shapes including, but not limited to double circular pipes, ovular pipes, and truncated triangular pipes as illustrated in U.S. Pat. No. 4,253,826 to Campbell.

Figure 6:
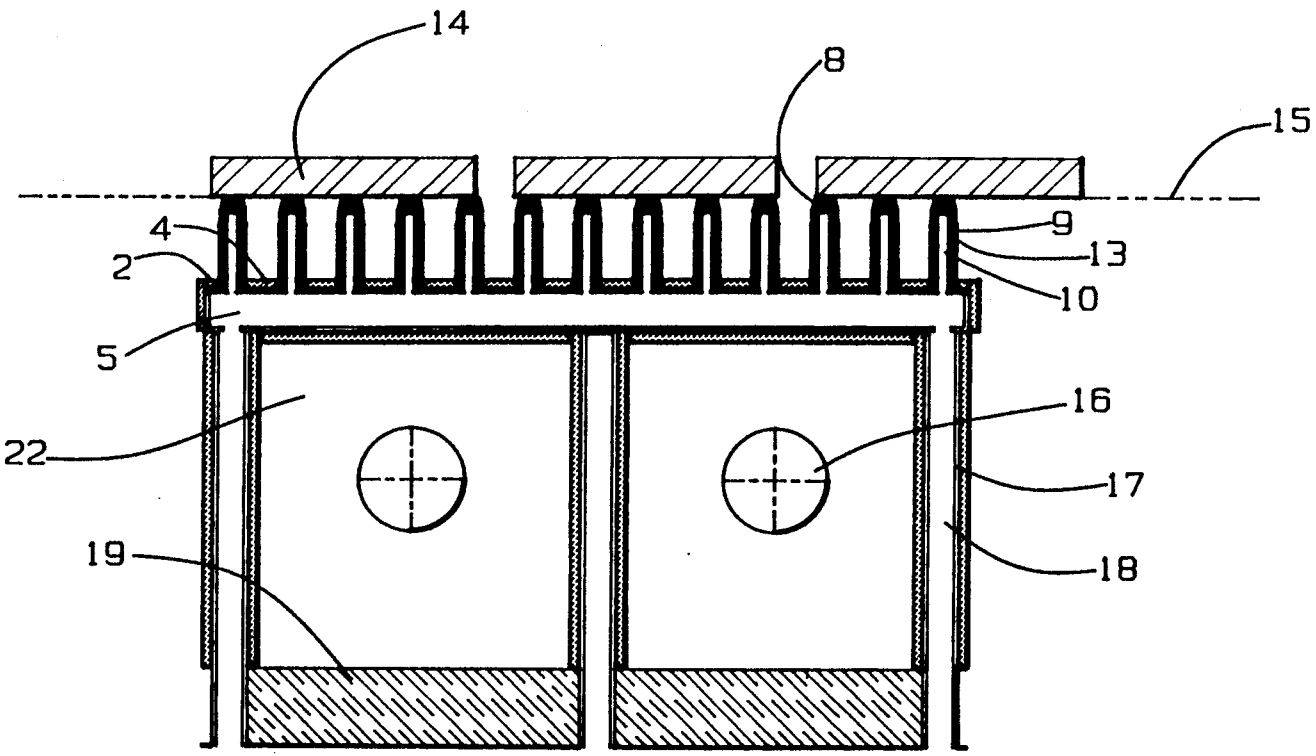
FIG. 6 is a schematic side view in cross section of a segment of a walking beam furnace equipped with a preferred embodiment of the invention showing the furnace floor, the vertical support pipes, the stationary skid pipe, and a plurality of risers supporting a series of slabs passing along the pass line of the furnace.

FIG. 6 schematically illustrates the relative positioning of the burner blocks 16 on one skid in a walking beam furnace as they emit energy directly into an emission area 22 generally unobstructed by the furnace floor 19, the water-cooled vertical support 17 having a passageway 18 therethrough and the skid 2 having its passageway 5 that may communicate with the fluid passage 18. FIG. 6 also illustrates a plurality of objects such as slabs 14 as they are walked through the furnace along the pass line 15. FIG. 6 also shows one embodiment of the invention having risers 9 supporting and positioning the slabs 14 is spaced apart relationship above the skid 2. It is generally accepted that the pass line will define the horizontal path of the slab 14 at the resting point in a walking beam furnace as it passes through the furnace as well as the path of the slab in a pusher furnace. The underlying infrastructure will then be configured to minimize and obstructions within the emission areas 22.

It is well known that the greatest heat transfer onto an object such as a slab 14 in a reheat furnace occurs by radiation from the heat sources such as burner blocks 16. As shown in FIG. 3A, when the conventional insulated skid pipe 2 and wear button 3 form a skid to support a slab, there is an area of radiation blockage relative to that specific skid. This area of radiation that is shielded from the underside of the slab 14 by the skid pipe casts a shadow upon the under side of the slab 14, and is termed the shadow effect 6A in this disclosure. The radiation allowed to impinge upon the slab 14 is shown by areas 7A in FIG. 3A.

Figure 3B:
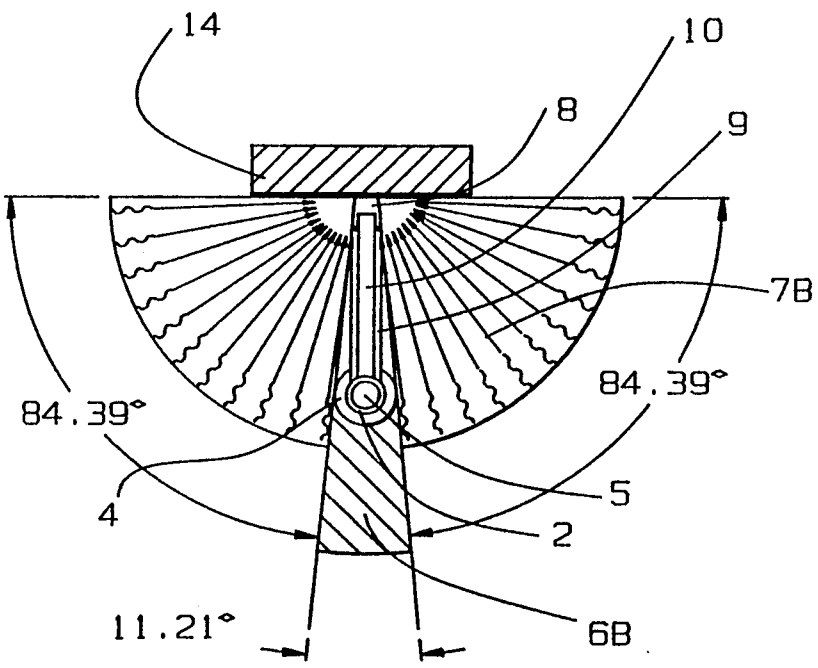
FIG. 3B is an elevational end view one embodiment of the invention applied to a walking beam furnace showing the reduced shadow effect and the increased radiation view angle on a point at the top of the wear button or cap supporting a slab.
Figure 3A:
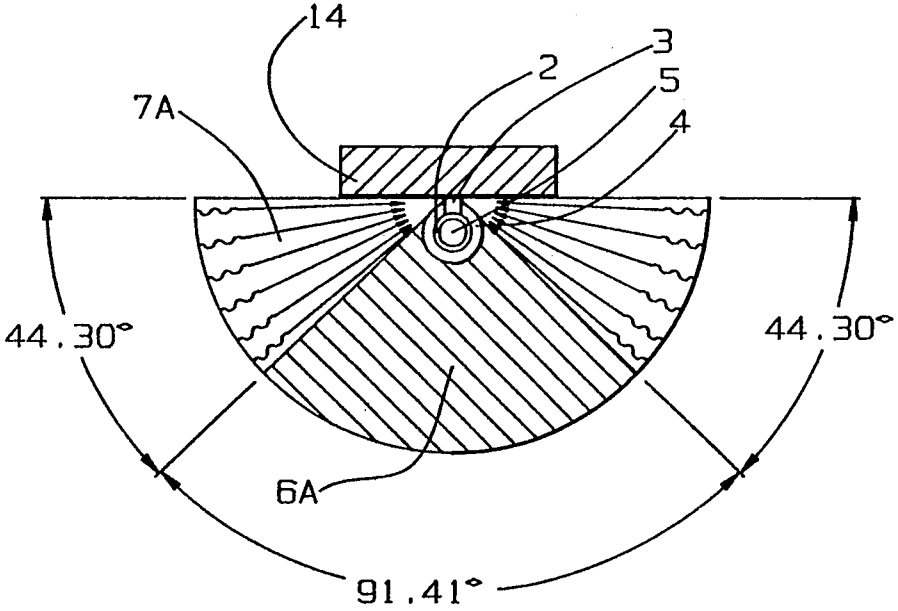
FIG. 3A is an elevational end view of a conventional skid pipe further showing the shadow effect and radiation view angles of the heat source upon the top of the button ordinarily supporting a slab.

Referring to FIG. 3B, for the same insulated skid pipe 2 having and outside diameter of about 11", as the skid is positioned further below the wear button or cap 8, the shadow effect 6B is greatly reduced and the radiation view angle 7B is greatly expanded thereby increasing the amount of thermal radiation bearing upon the under side of the slab 14. Fundamental trigonometry mandates that the longer the riser 9, the greater must be the radiation view angle 7B. It is understood, however, that unnecessary elongation of the riser 9 will eventually position the skid pipe 2 within the emission area 22 thereby hindering the flow of heat being emitted from the burner blocks 16. It is further clear that continued elongation of the risers 9 will trigonometrically yield and ever smaller rate of decrease in the shadow effect, the columnar load on the riser 9 may become undesirable, and the amount of material cost in the riser 9 increases.

As the slab 14 sits on the wear button 3, heat is conducted from the contiguous portion of the slab through the wear button 3 into the skid pipe 2. The combination of the shadow effect and the conduction heat loss produces cold spots within the slab which are the principal cause of gauge variation in the subsequent sheet rolling process. The loss of heat transfer from the shadow effect far outweighs the conventional loss by conductivity through the button 3. Thus, the reduction of the shadow effect upon the bottom surface of the slab 14 will have the greatest effect upon reducing the effects of cold spots within the slab.

In a pusher type furnace shown in FIG. 12, a number of methods conventionally have been employed to reduce the effects of cold spots on a slab by laterally displacing the skids 40 in the discharge end of the furnace. The lower part of area 38 is a first cold spot. It rests on the wear bars 24 and is the coolest location due to thermal conductivity and radiation blockage. By offsetting the skids shown at 40, the first cold spot is now exposed to some radiation and relieved from conductive heat loss, thus becoming warmer; yet, a new second cold spot 39 begins to appear, thus creating another cold spot that will affect the gauge of the later formed strip. Those skilled in the art realize that the effectiveness of the offset skid method depends in part upon the factors of radiation, conduction and convention between the slab 14 and all of the furnace components including the furnace walls and roof (not shown), the floor 19 and the skids 2. The furnace geometry must carefully be matched to the slab travel (pacing rate) and the slabs residence time in order to increase the radiation on the first cold spot 38 while minimizing the introduction of a second cold spot 39 on the slab 14. One such offset skid method has reduced the prior gauge variation from plus or minus 0.008" to plus or minus 0.005–006".

Figure 2:
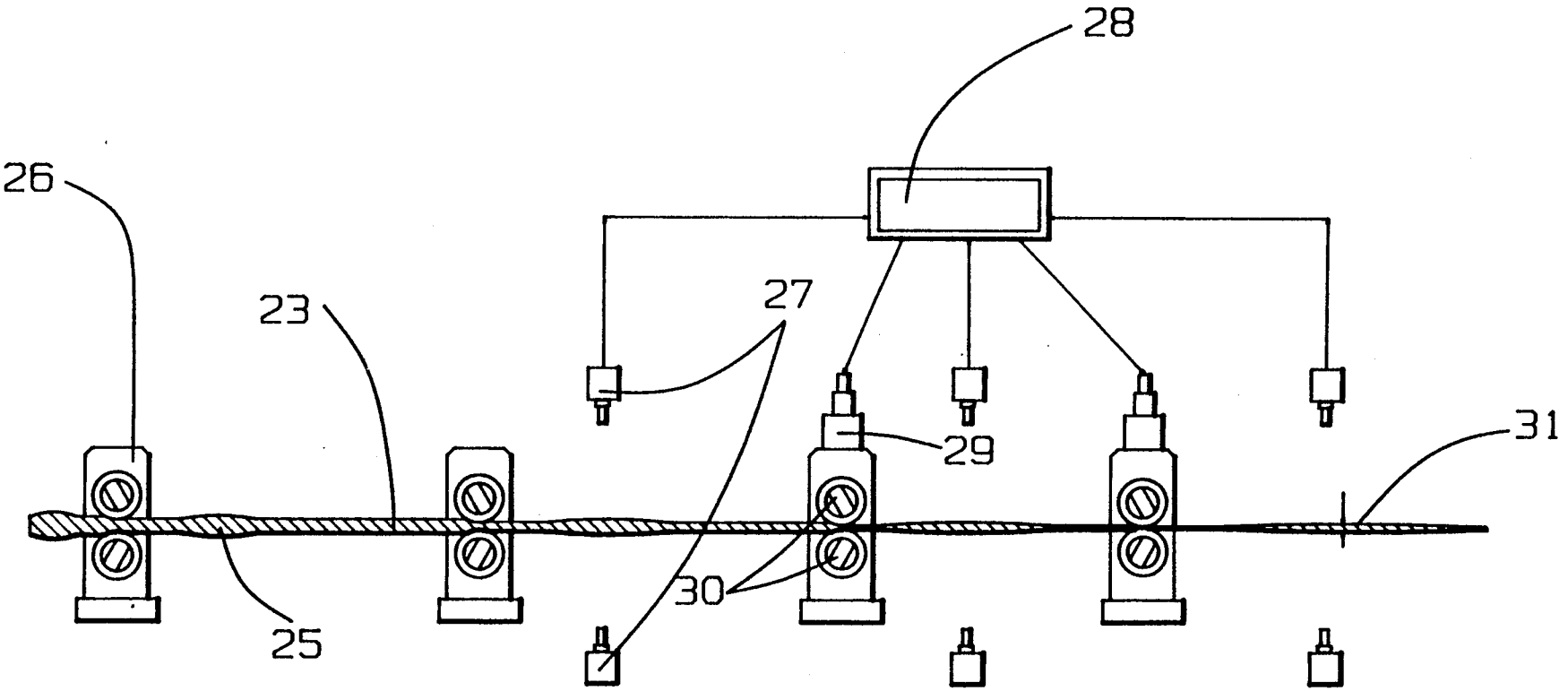
FIG. 2 is a schematic illustration of a typical rolling mill operation showing various rolling mill stands, the strip being rolled, some of the x-ray thickness measuring units often used to measure the gauge of the strip the automatic gauge control computer and a succession of ever diminishing thick spots caused by cold spots.

As shown in FIG. 2, a slab has been reduced in thickness to form a sheet or strip 23 passing through a series of mill stands 26. The sheet 23 has thicker areas 25 corresponding to the cold regions which are sensed by such methods as an x-ray thickness sensing unit 27 feeding information into an automatic gauge control computer 28 which calculates such data as the variation in thickness and the velocity of the strip 23. The automatic gauge control computer 28 then sends a signal to a mill adjustment unit 29 having rollers 30 which are variably and hydraulically biased toward one another. The mill adjustment unit is thus signaled as a thick region 25 passes through the rollers 30 so that the rollers 30 can be squeezed against the strip 23 to reduce the excessive thickness in the cold region. By illustration, the thick regions 25 are eventually extended lengthwise but reduced in thickness as shown in the reduced thickness cold area 31.

The reduction of the intensity of the cold spots on the original slab 14 therefor will reduce the complexity of the tasks required in the mill operation illustrate in FIG. 2 and permit small variations in gauge of the strip 23.

Figure 4:
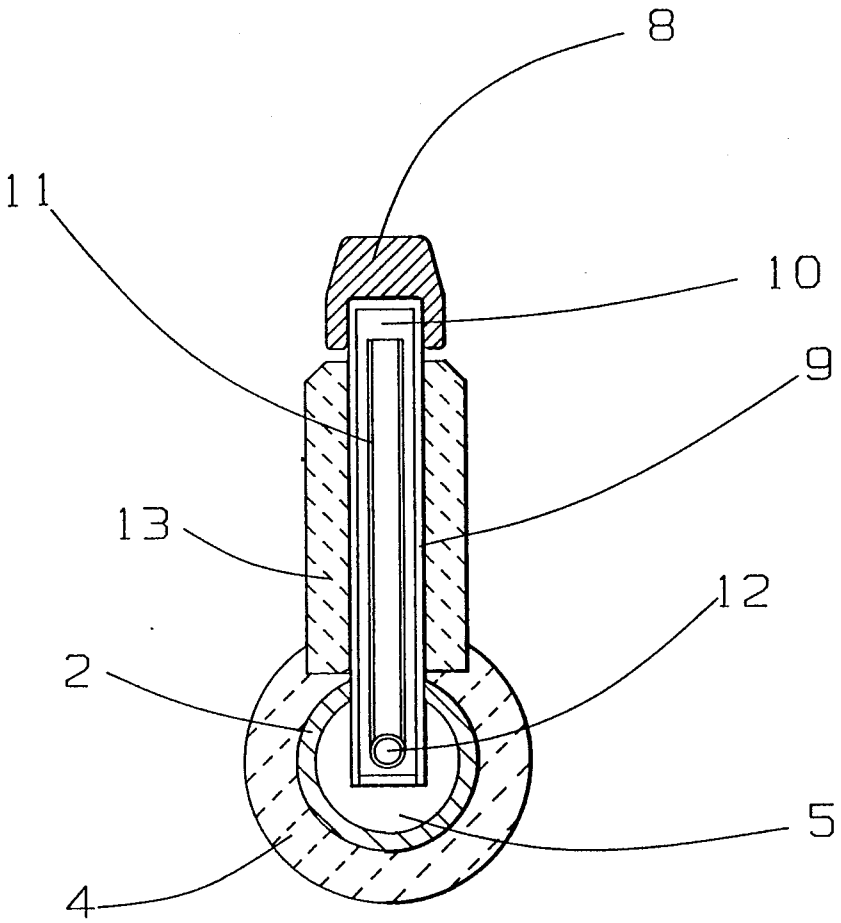
FIG. 4 is an elevation end view in cross section viewed in the direction of lines 4—4 of FIG. 5 of the preferred embodiment of the invention for a walking beam furnace showing the skid pipe, insulation around the skid pipe, riser, riser insulation and the wear button or cap for supporting an object.

A preferred embodiment of the present invention for a walking beam furnace is shown in FIG. 4. Any conventional skid pipe 2, regardless of its geometry, has an elongated riser 9 having two ends with the lower end affixed, for example, by welding to the skid pipe 2. At the upper most end of the riser 9 is an appropriate wear resistant device such as a cap 8 preferably comprising a high temperature alloy known in the art. These caps 8 support the slab 14 as do the conventional wear bar 24 in the pusher type furnaces and the conventional wear button 3 of FIG. 1. The cross section of the cap 8 may be varied and can be of any effective and economical shape. A cap 8 made from a conventional high temperature alloy riser tile can be larger in cross section and exhibit higher compressive strengths at elevated temperatures than conventional steel wear bars welded to a skid pipe. A cap 8 made from such material can have an effective operating height of up to approximately 3" thus increasing the temperature at the slab-tile interface above that encountered when using welded wear bars or wear buttons that often are approximately 1.5" in height.

Those skilled in the art will understand that even the cap 8 height is limited by the allowable load upon that cross section at any specific temperature. If the cap 8 is made too high, it will increase in temperature sufficiently to cause subsidence or creep of the alloy material.

The riser 9 in FIG. 4 is insulated by any suitable insulator 13. It is understood that when seeking to reduce the shadow effect upon the supported slab 14, a minimum outside diameter of a skid pipe 2 and insulator 4 combination and the riser 9 and insulator 13 combination is desired and depends in part from the support capability of the skid pipe 2 and the riser 9.

Figure 5:
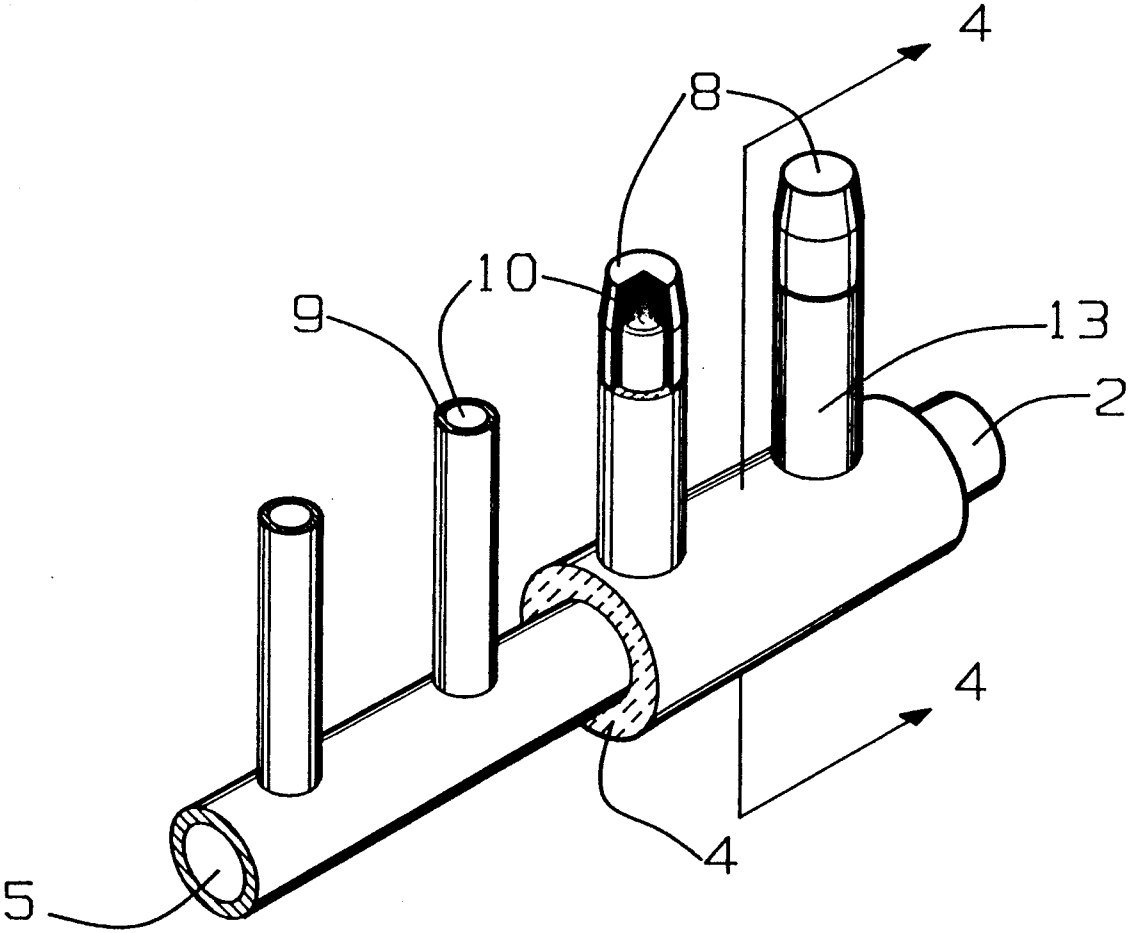
FIG. 5 is an isometric view of a segment of the preferred embodiment of the invention for a walking beam furnace.
Figure 7:
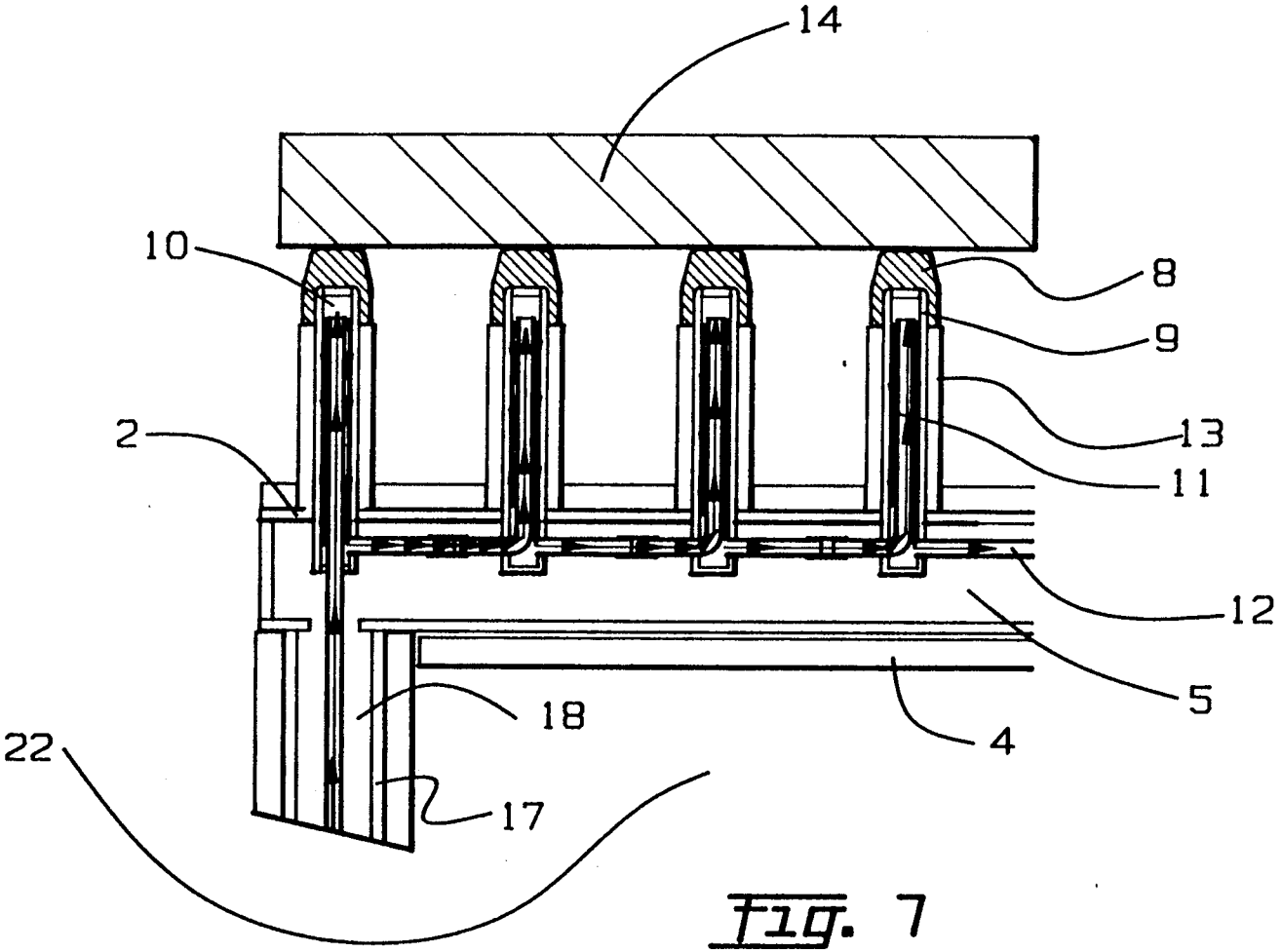
FIG. 7 is a schematic side elevational view in cross section of the invention showing a portion of the vertical pipe, a portion of the skid pipe, a plurality of risers supporting a slab and a preferred method for cooling the riser pipes.

The riser 9 has a passage 10 within it for permitting a cooling fluid to flow within. One such method of effectuating fluid flow within the riser 9 is, by way of example and not by limitation, to introduce the fluid through a riser feeder pipe 11 communicating with the fluid passage 10. As shown in FIG. 7, the riser feeder pipe 11 for each riser 9 can be interconnected by means of riser connecting feeders 12. Arrows show the flow direction. Those skilled in the art will realize that the fluid flowing within the risers 9 may be supplied from any suitable source, including the fluid within the vertical support fluid passage 18, the fluid passage 5 or from a different source. In FIG. 5 an isometric view of a segment of a conventional skid pipe 2 utilizing the risers 9 also shows a partial cross section of the caps 8 and an exterior view of the risers with the riser insulation 13 and caps 8.

FIG. 3B, illustrating a 36" riser and an 11" outside diameter insulated skid pipe, shows the reduced shadow effect 6B in comparison to the shadow effect 6A of a conventional skid in FIG. 3A from approximately 91° to approximately 11°.

Figure 8:
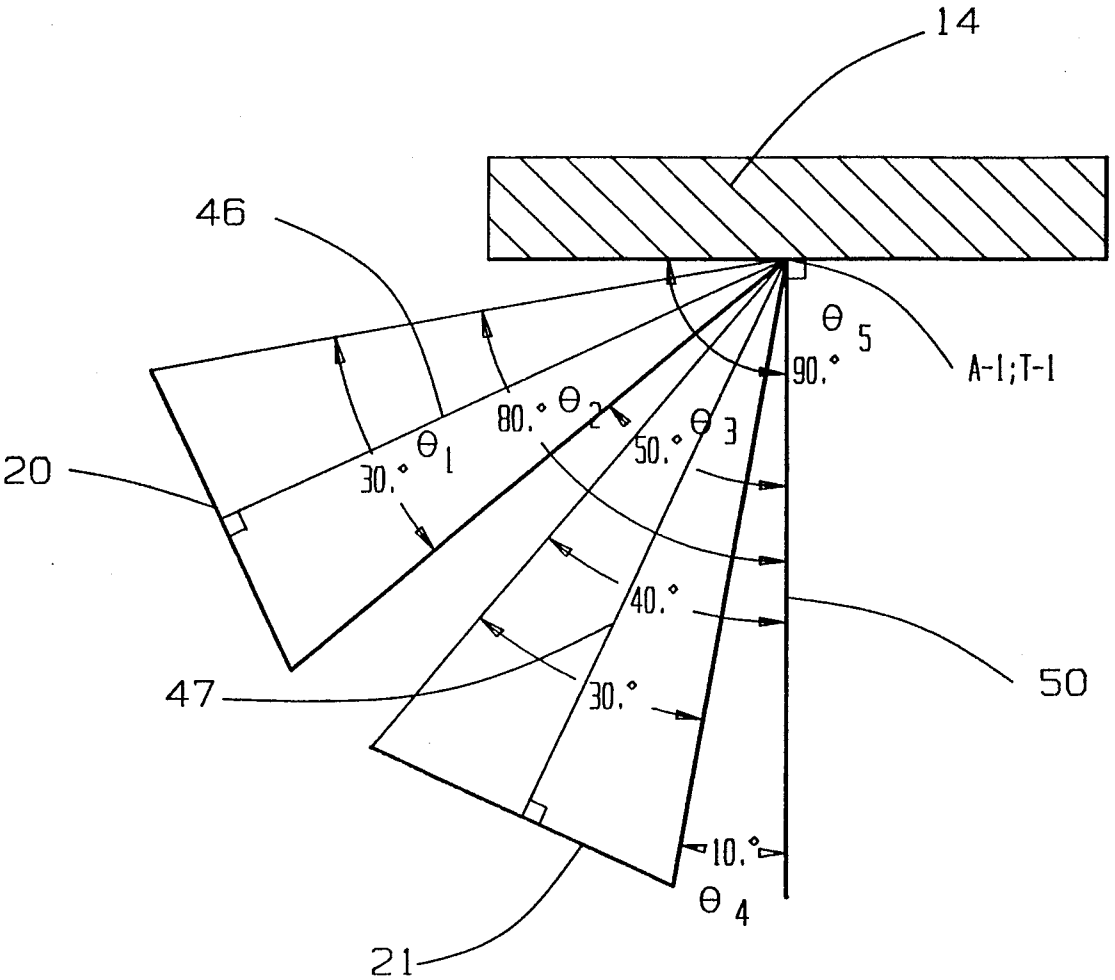
FIG. 8 is a schematic view of two equal radiation sources illustrating the effect of increasing the amount of radiation upon the slab and increasing the angle of incidence of the radiation on the bottom surface of a slab.

As shown in FIG. 8, it is not the mere increase in the amount of the radiation upon the slab 14 which increases the thermal radiation heat transfer to the slab 14, but also the increased angle of incidence at which the additional radiation impinges upon the bottom surface of the slab. In FIG. 8 two equal sources of radiation of 30° arc each are shown by their chords 20 and 21. Both sources illustrate an equal amount of radiation impinging on the bottom surface of a slab at an area A−1 and at a temperature T−1. The line 46 eminates from A−1 and is normal to the 20 chord at temperature T−2. Similarly, a normal 47 connects A−1 at temperature T−1 to the chord 21 also at temperature T−2. Line 50 represents a normal to the bottom of the slab 14. Under these conditions, the following calculations apply:

$$T-2 > T-1$$

$$20 = \frac{\mathrm{Sin}(\Theta_5 - \Theta_2) - \mathrm{Sin}(\Theta_5 - \Theta_1)}{2}$$

$$21 = \frac{\mathrm{Sin}(\Theta_5 - \Theta_4) - \mathrm{Sin}(\Theta_5 - \Theta_3)}{2}$$

$$\text{Chord } 20 = .1094$$
$$\text{Chord } 21 = .2361$$

$$\frac{\text{Chord } 21}{\text{Chord } 20} = \frac{.2361}{.1094} = 2.158$$

It is clear that for equal heat sources, the energy radiated upon area A−1 through chord 21 is significantly greater than the radiation passing through chord 20. Those ordinarily skilled in heat transfer understand that the more perpendicular to a surface the radiation, the greater is the effect of that radiation upon the surface. Thus it is not only the increase in the amount of available radiation, but also the alignment of that radiation angle normal to the surface to be radiated which increases the thermal radiation heat transfer.

Figure 9:
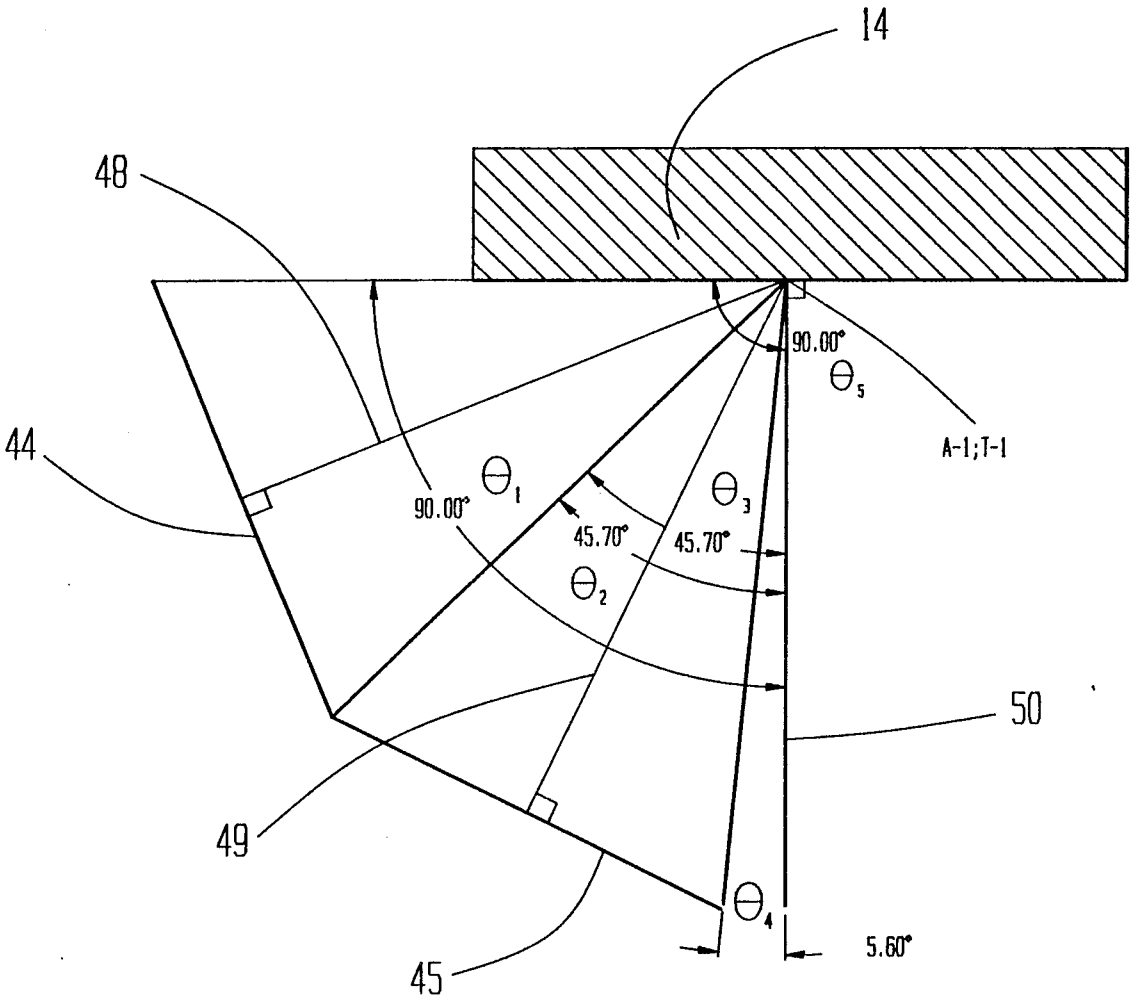
FIG. 9 is a schematic illustration similar to FIG. 8 but further showing the total improved thermal radiation heat transfer upon the under side of a slab with increased angle of incidence of the radiation relative to the lower surface of the slab.

FIG. 9 illustrates by example the cumulative effect of the increase in thermal radiation heat transfer upon area A−1 at temperature T−1 by adding, for example, the additional radiation heat source shown as chord 45 to a conventional heat source shown as chord 44. Again the normals 48 for chord 44 and 49 for chord 45 intersect area A−1 at temperature T−1 . The added heat source 45 has an increased angle of incidence when compared to the heat source identified by the chord 44. The numbers are for comparative purposes only and would depend upon the various skid pipe/insulator diameters and lengths of risers.

The comparison shows the compounding effect of the sum of both heat sources 44 and 45 compared to only the conventional heat source 44.

$$\text{Heat Source } 44 = \text{Heat source } 45, \text{ both at temperature } T-2$$
$$T-2 > T1$$

$$44 = \frac{\mathrm{Sin}(\Theta_5 - \Theta_2) - \mathrm{Sin}(\Theta_5 - \Theta_1)}{2}$$

$$45 = \frac{\mathrm{Sin}(\Theta_5 - \Theta_4) - \mathrm{Sin}(\Theta_5 - \Theta_3)}{2}$$

For Conventional Skid: Heat Source 44 = .3493
For Invention: Heat Source 45 = .8471
Total Heat Source = 44 + 45 = 1.1965

$$\text{HEAT SOURCE RATIO} = \frac{\text{Total Heat Source}}{\text{Conventional Heat Source}} = \frac{1.1965}{.3494} = 3.424$$

Under these circumstances the new invention permits more than three times the thermal heat radiation transfer than the prior art, thus reducing the amount of energy expended within the furnace process.

Figure 10:
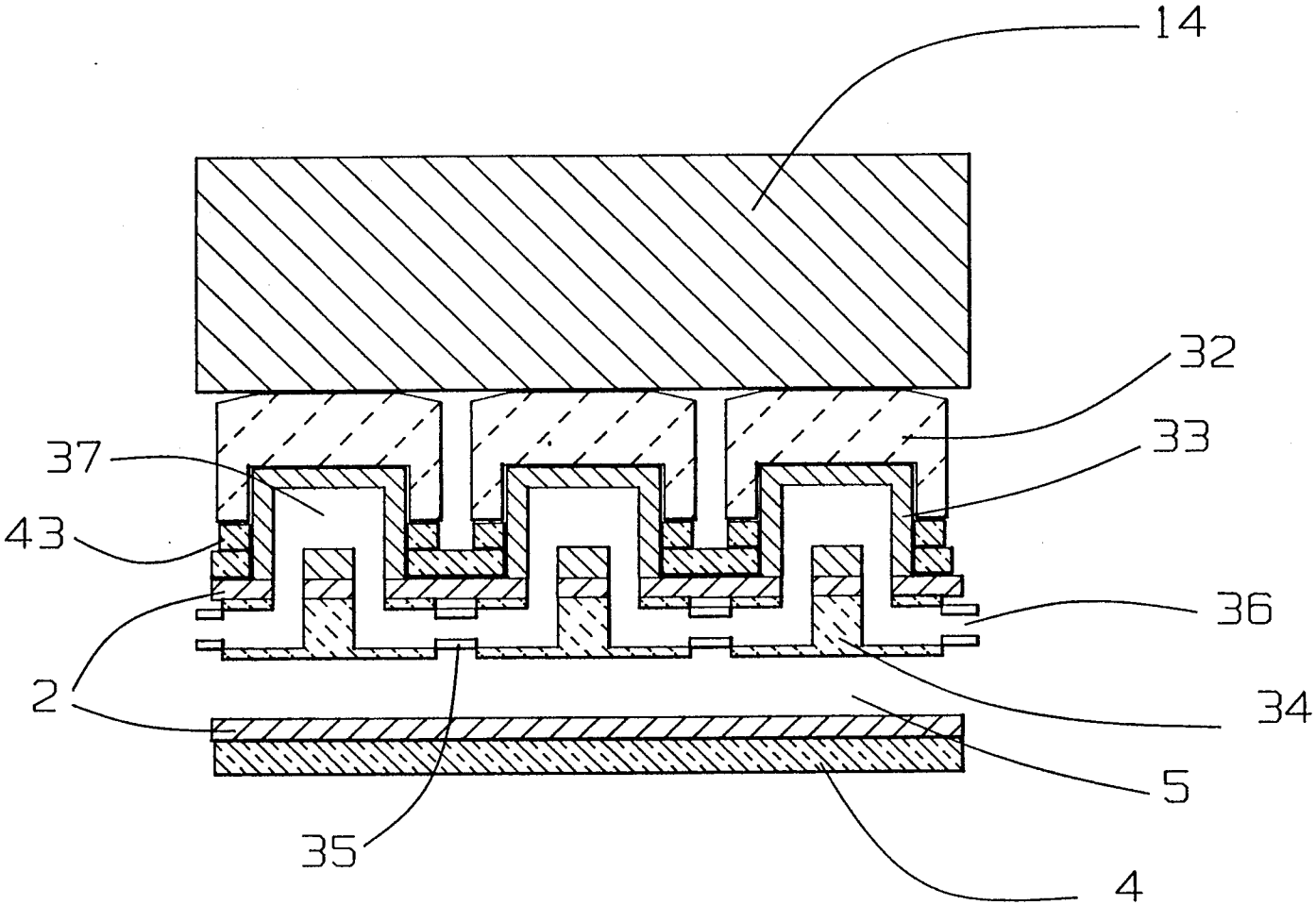
FIG. 10 is a side elevational view in cross section viewed in the direction of lines 10 to 10 of FIG. 13 showing three insulated riser members and their caps supporting a slab in a pusher type furnace.

Similarly, an alternative structure shown in FIG. 10 would support the invention when used in a pusher furnace. Again any conventional skid pipe 2, surrounded by an insulator 4 and having a passageway 5 therethrough is adapted by inserting and securing a water directional casting 34 within the passageway 5. A riser casting 33 is affixed to the skid pipe 2 which has a pair of holes through it to form a riser fluid passage 37 suitable for communicating a fluid coolant therein which flows from one riser passage 37, into the uppermost part of passageway 5, through a water connecting pipe 35 having a connecting passageway 36 and repeating for all existing riser castings 33, each of which has an insulator 43 and a rider tile 32 made of any material suitable for the caps 8. The slab 14 is pushed along the top of the rider tiles 32.

The present invention as described, illustrated and claimed, therefore, fully supports and meets the objects of the invention. Although a preferred embodiment has been described and claimed, those skilled in the art understand that numerous modifications, amendments and alterations of the invention, including the structure illustrating the invention, will occur all of which clearly fall within both the spirit and the scope of the specification, drawings and the claims herein.

What is claimed is:

1. A device for increasing the thermal radiation heat transfer to an object having a bottom surface and located within a furnace comprising:

A. An internally fluidically cooled, substantially horizontal first support means; and B. a fluidically cooled second support means projecting substantially upwardly from the first support means for positioning and supporting the object in spaced apart relationship above the first support means.

2. The device of claim 1 wherein the first and second support means are in fluid communication with one another.

3. The method of claim 1 wherein the second support means is a substantially vertical, fluidically cooled elongated member.

4. The device of claim 1 wherein the second support means has a lower end fluidically connected to the first support means and a second end having a nonfluidically communicating cap for contacting and supporting the bottom surface of the object, said cap being in thermal communication with the second support means.

5. A device for increasing the thermal radiation heat transfer to an object in a reheat furnace, said object having a bottom surface, comprising the combination of:

A. A substantially horizontal, fluidically cooled first support structure; and

B. A fluidically cooled second support means projecting substantially upwardly from the first support structure for positioning and supporting the object in spaced apart relationship above the first support structure.

6. The device of claim 5 wherein the first and second support means are in fluid communication with one another.

7. The device of claim 5 wherein the second support structure has a lower end secured to the first support structure and an upper end terminating the cap for contacting and supporting the bottom surface of the object, said cap being in thermal communication with the second support structure.

* * * * *